US006409560B1

(12) United States Patent
Austin

(10) Patent No.: US 6,409,560 B1
(45) Date of Patent: Jun. 25, 2002

(54) MOTORIZED SURFBOARD DEVICE

(76) Inventor: Shawn M. Austin, 1828 N. Allen Ave., Pasadena, CA (US) 91104

( * ) Notice: Subject to any disclaimer, the term of this patent is extended or adjusted under 35 U.S.C. 154(b) by 0 days.

(21) Appl. No.: 09/833,430

(22) Filed: Apr. 12, 2001

(51) Int. Cl.[7] ..... B63B 35/79
(52) U.S. Cl. ..... 441/74; 440/6
(58) Field of Search ..... 441/65, 74, 79; 440/6; 114/315

(56) References Cited

U.S. PATENT DOCUMENTS 3,405,677 A 10/1968 Smith
3,456,613 A 7/1969 Smith
3,536,025 A 10/1970 Tierney
4,020,782 A 5/1977 Gleason
4,274,357 A 6/1981 Dawson
D260,797 S 9/1981 Calengor et al.
5,516,126 A * 5/1996 Myers ..... 441/65

* cited by examiner

*Primary Examiner*—Stephen Avila

(57) ABSTRACT

A motorized surfboard device for propelling a surfboard having a user thereon through water. The motorized surfboard device includes a panel having a front edge, a back edge, a pair of side edges, a bottom surface and a top surface. The panel comprises a buoyant material such that the panel floats in water. A motor housing is attached to the bottom surface of the panel. The motor housing has a distal wall, a proximal wall and a pair of lateral walls with respect to the front edge of the panel. The motor housing is substantially watertight. A drive motor is positioned in the housing. A propeller is mechanically coupled to the drive motor and is positioned between the back edge of the panel and the distal wall of the housing. A power supply is operationally coupled to the drive motor and positioned in the motor housing.

16 Claims, 3 Drawing Sheets

MOTORIZED SURFBOARD DEVICE

BACKGROUND OF THE INVENTION

1. Field of the Invention

The present invention relates to surfboard devices and more particularly pertains to a new motorized surfboard device for propelling a surfboard having a user thereon through water.

2. Description of the Prior Art

The use of surfboard devices is known in the prior art. More specifically, surfboard devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,274,357; 3,536,025; 3,405,677; 3,456,613; 4,020,782; and U.S. Des. Pat. No. 260,797.

While these devices fulfill their respective, particular objectives and requirements, the aforementioned patents do not disclose a new motorized surfboard device. The inventive device includes a panel having a front edge, a back edge, a pair of side edges, a bottom surface and a top surface. The panel comprises a buoyant material such that the panel floats in water. A motor housing is attached to the bottom surface of the panel. The motor housing has a distal wall, a proximal wall and a pair of lateral walls with respect to the front edge of the panel. The motor housing is substantially watertight. A drive motor is positioned in the housing. A propeller is mechanically coupled to the drive motor and is positioned between the back edge of the panel and the distal wall of the housing. A power supply is operationally coupled to the drive motor and positioned in the motor housing.

In these respects, the motorized surfboard device according to the present invention substantially departs from the conventional concepts and designs of the prior art, and in so doing provides an apparatus primarily developed for the purpose of propelling a surfboard having a user thereon through water.

SUMMARY OF THE INVENTION

In view of the foregoing disadvantages inherent in the known types of surfboard devices now present in the prior art, the present invention provides a new motorized surfboard device construction wherein the same can be utilized for propelling a surfboard having user thereon through water. The general purpose of the present invention, which will be described subsequently in greater detail, is to provide a new motorized surfboard device apparatus and method which has many of the advantages of the surfboard devices mentioned heretofore and many novel features that result in a new motorized surfboard device which is not anticipated, rendered obvious, suggested, or even implied by any of the prior art surfboard devices, either alone or in any combination thereof.

To attain this, the present invention generally comprises a panel having a front edge, a back edge, a pair of side edges, a bottom surface and a top surface. The panel comprises a buoyant material such that the panel floats in water. A motor housing is attached to the bottom surface of the panel. The motor housing has a distal wall, a proximal wall and a pair of lateral walls with respect to the front edge of the panel. The motor housing is substantially watertight. A drive motor is positioned in the housing. A propeller is mechanically coupled to the drive motor and is positioned between the back edge of the panel and the distal wall of the housing. A power supply is operationally coupled to the drive motor and positioned in the motor housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new motorized surfboard device apparatus and method which has any of the advantages of the surfboard devices mentioned heretofore and many novel features that result in a new motorized surfboard device which is not anticipated, rendered obvious, suggested, or even implied by any of the prior art surfboard devices, either alone or in any combination thereof.

It is another object of the present invention to provide a new motorized surfboard device which may be easily and efficiently manufactured and marketed.

It is a further object of the present invention to provide a new motorized surfboard device which is of a durable and reliable construction.

An even further object of the present invention is to provide a new motorized surfboard device which is susceptible of a low cost of manufacture with regard to both materials and labor, and which accordingly is then susceptible of low prices of sale to the consuming public, thereby making such motorized surfboard device economically available to the buying public.

Still yet another object of the present invention is to provide a new motorized surfboard device which provides in the apparatuses and methods of the prior art some of the advantages thereof, while simultaneously overcoming some of the disadvantages normally associated therewith.

Still another object of the present invention is to provide a new motorized surfboard device for propelling a surfboard having a user thereon through water.

Yet another object of the present invention is to provide a new motorized surfboard device which includes a panel having a front edge, a back edge, a pair of side edges, a bottom surface and a top surface. The panel comprises a buoyant material such that the panel floats in water. A motor housing is attached to the bottom surface of the panel. The motor housing has a distal wall, a proximal wall and a pair of lateral walls with respect to the front edge of the panel. The motor housing is substantially watertight. A drive motor is positioned in the housing. A propeller is mechanically coupled to the drive motor and is positioned between the back edge of the panel and the distal wall of the housing. A power supply is operationally coupled to the drive motor and positioned in the motor housing.

Still yet another object of the present invention is to provide a new motorized surfboard device that allows a person of little surfboard riding skill to operate a surfboard in relatively calm water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than hose set forth above will become apparent when consideration is given to the following detailed description thereof. Such description makes reference to the annexed drawings wherein.

DESCRIPTION OF THE PREFERRED EMBODIMENT

Figure 1:
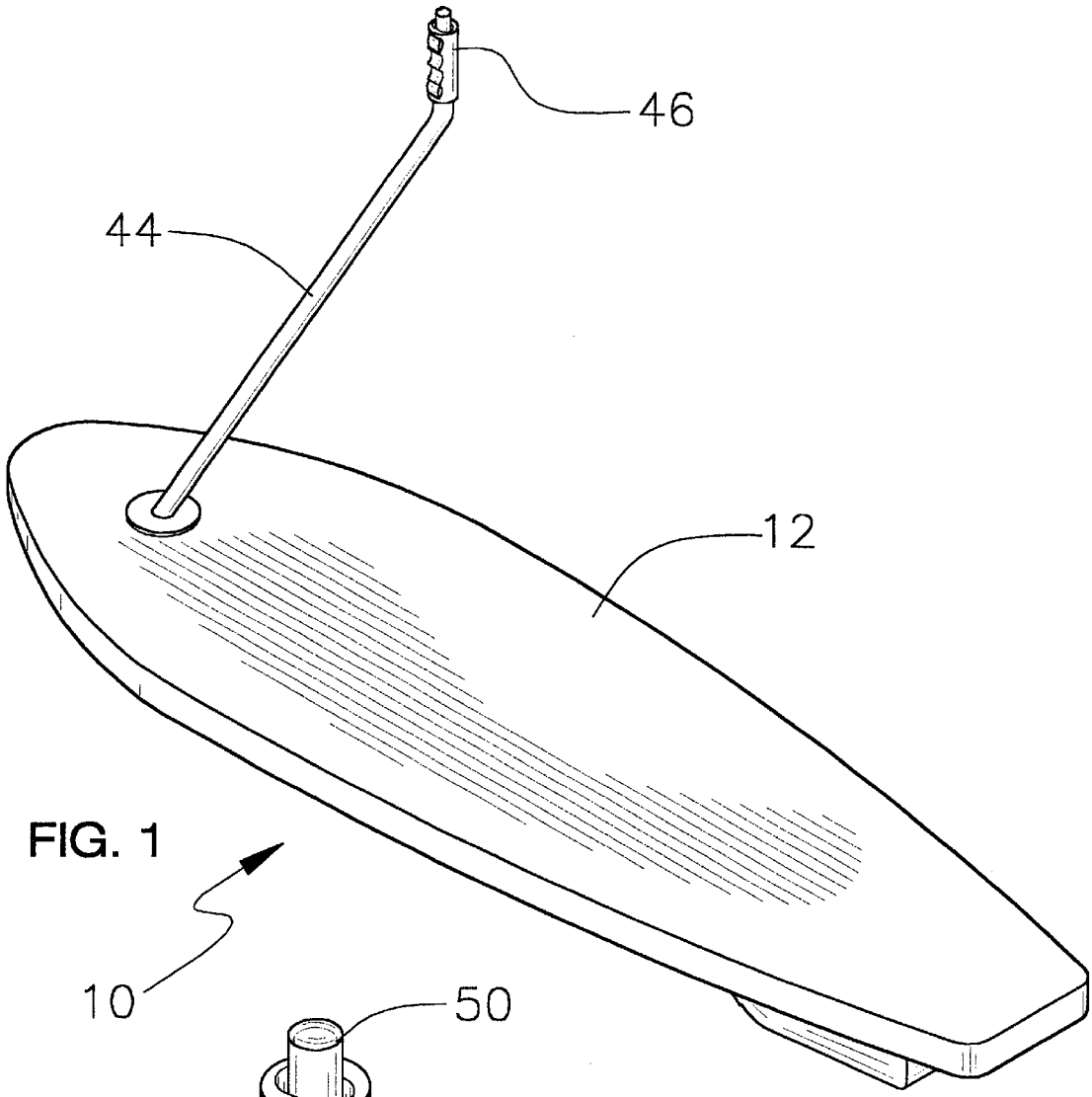
FIG. 1 is a schematic perspective view of a new motorized surfboard device according to the present invention.
Figure 2:
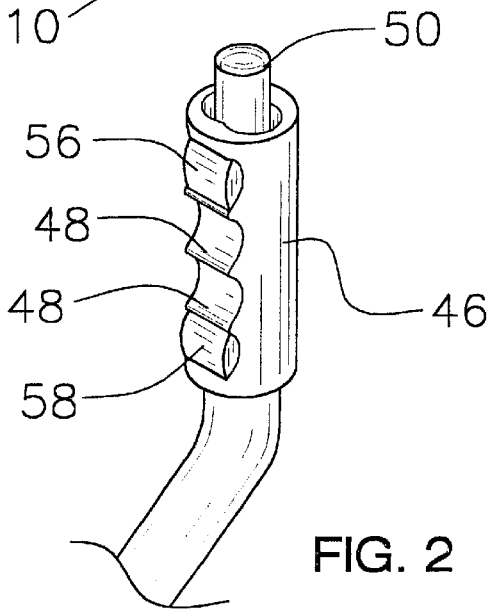
FIG. 2 is a schematic perspective view of the handgrip of the present invention.
Figure 3:
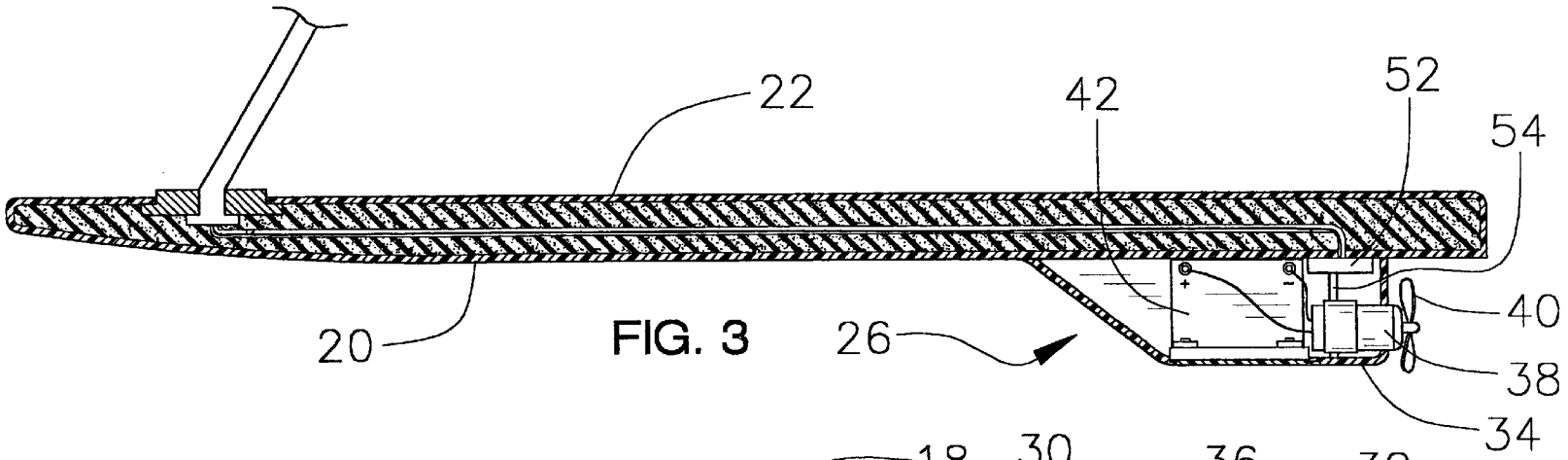
FIG. 3 is a schematic cross-sectional view of the present invention.
Figure 4:
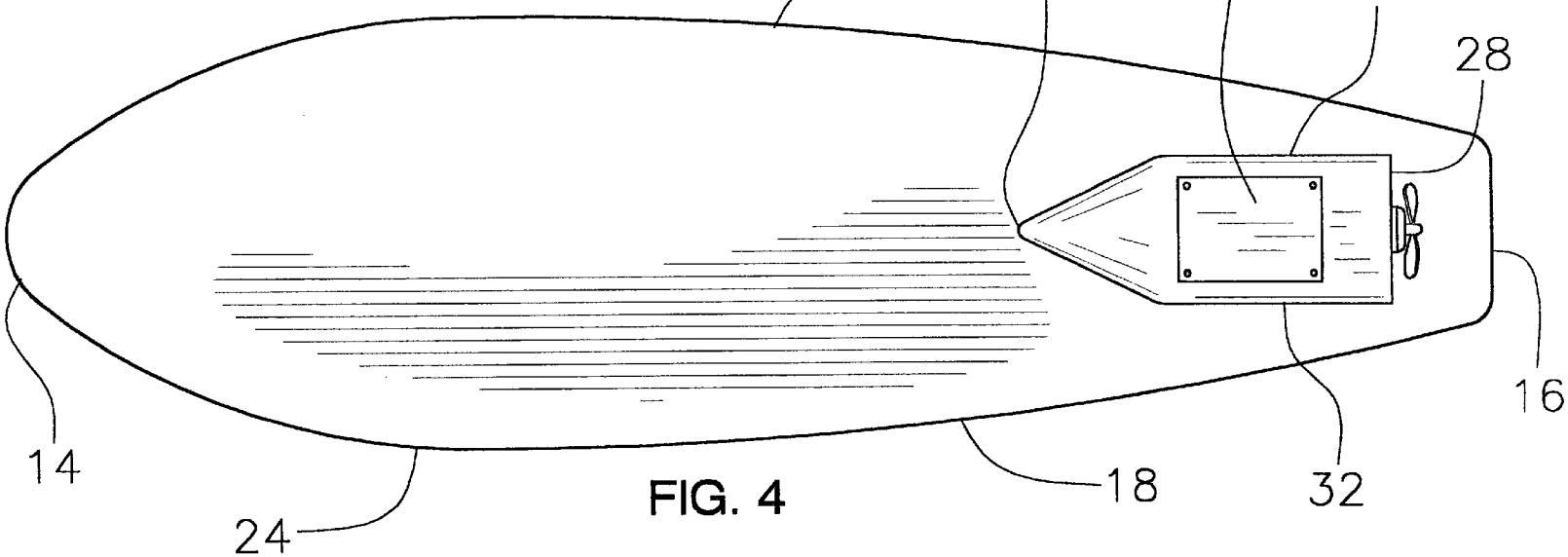
FIG. 4 is a schematic bottom view of the present invention.
Figure 5:
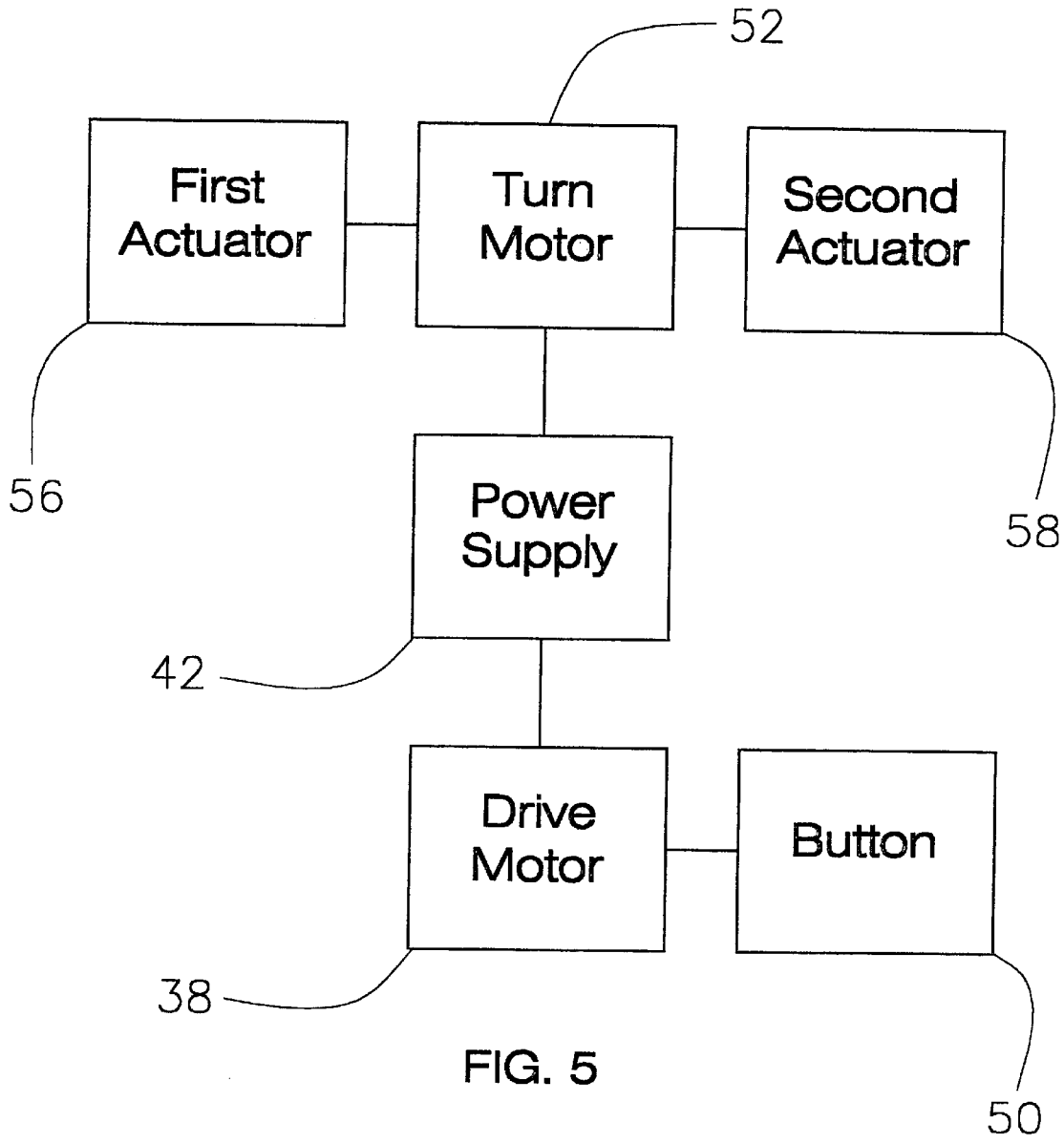
FIG. 5 is an electronic schematic view of the present invention.

With reference now to the drawings, and in particular to FIGS. 1 through 5 thereof, a new motorized surfboard device embodying the principles and concepts of the present invention and generally designated by the reference numeral 10 will be described.

As best illustrated in FIGS. 1 through 5, the motorized surfboard device 10 generally comprises a panel 12 having a front edge 14, a back edge 16, a pair of side edges 18, a bottom surface 20 and a top surface 22. The panel 12 comprises a buoyant material such that the panel 12 floats in water and generally includes conventional surfboard type panels. The front edge 14 is generally rounded. The panel 12 widens between the side edges 18 from the back edge 16 to a point, 24 generally between a middle portion of he panel 12 and the front edge 14 of the panel 12. The side edges 18 taper from the point to the front edge 14.

A motor housing 26 is attached to the bottom surface 20 of panel 12. The motor housing 26 is positioned nearer the back edge 16 than the front edge 14 of the panel 12. The motor housing 26 has a distal wall 28, a proximal wall 30 and a pair of lateral walls 32 with respect to the front edge 14 of the panel 12. The lateral walls 32 taper to the proximal wall 30 such that the proximal wall 30 is generally pointed. The housing 26 has a bottom wall 34 having a removable panel 36 therein for selectively accessing an interior of the housing 26. The motor housing 26 is substantially watertight.

A drive motor 38 is positioned in the housing 26. A propeller 40 is mechanically coupled to the drive motor 38. The propeller 40 is positioned between the back edge 16 of the panel 12 and the distal wall 28 of the housing 26. The drive motor 38 preferably comprises an electric motor.

A power supply 42 is operationally coupled to the drive motor 38. The power supply 42 is positioned in the motor housing 36. The power supply 42 preferably comprises a battery.

A handle 44 is secured to the top surface 22 of the panel 12. The handle 44 includes a bar extending upwardly from the panel 12. A handgrip 46 is attached to a free end of the bar. The handgrip 46 has a plurality of indentations 48 therein for receiving fingers of a user.

A button 50 is positioned on the handle 44 for selectively turning the drive motor 38 on or off. The button 50 is operationally coupled to the drive motor 38.

A turning means turns the drive motor 38 and includes a turn motor 52 mounted in the housing. A rod 54 is coupled to the turn motor 52. The rod 54 is coupled to the drive motor 38. The turn motor is adapted for rotating the rod 54. A first actuator 56 for rotating the bar 54 in a first direction is mounted on the handle 44. A second actuator 58 for rotating the rod 54 in a second direction is mounted on the handle 44. The first 56 and second 58 actuators are operationally coupled to the turn motor 52. The turn motor 52 is operationally coupled to the power supply 42.

In use, the panel 12 is stood on in a manner similar to a conventional surfboard. The handle 44 is used for steadying the user and for actuating the drive and turn motors.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A motorized surfboard comprising:

a panel having a front edge, a back edge, a pair of side edges, a bottom surface and a top surface, said panel comprising a buoyant material such that said panel floats in water;

a motor housing being attached to said bottom surface of said panel, said motor housing having a distal wall, a proximal wall and a pair of lateral walls with respect to said front edge of said panel, said motor housing being substantially watertight;

a drive motor being positioned in said housing, a propeller being mechanically coupled to said drive motor, said propeller being positioned between said back edge of said panel and said distal wall of said housing;

a handle being secured to said top surface of said panel, said handle including a bar extending upwardly from said panel, a handgrip being attached to a free end of said bar, said handgrip having a plurality of indentations therein for receiving fingers of a user, a button being positioned on said handle for selectively turning said drive motor on or off, said button being operationally coupled to said drive motor;

a turning means for turning said drive motor, said turning means being operationally coupled to said drive motor; and a power supply being operationally coupled to said drive motor and positioned in said motor housing.

2. The motorized surfboard as in claim 1, wherein said front edge is generally rounded, said panel widening between said side edges from said back edge to point generally between a middle portion of said panel and said front edge of said panel, said side edges tapering from said point to said front edge.

3. The motorized surfboard as in claim 1, wherein said motor housing is positioned nearer said back edge than said front edge of said panel, said motor housing having a distal wall, a proximal wall and a pair of lateral walls with respect to said front edge of said panel, said lateral walls tapering to said proximal wall such that said proximal wall is generally pointed.

4. The motorized surfboard as in claim 1, wherein said housing has a bottom wall having a removable panel therein for selectively accessing an interior of said housing for removing said power supply disposed thereon.

5. The motorized surfboard as in claim 1, wherein said drive motor comprises an electric motor and said power supply comprises a battery.

6. The motorized surfboard as in claim 1, wherein said turning means comprises a turn motor mounted in said housing, a rod being coupled to said turn motor, said rod being coupled to said drive motor, said turn motor being adapted for rotating said rod, a first actuator for rotating said rod in a first direction being mounted on said handle, a second actuator for rotating said rod in a second direction being mounted on said handle, said first and second actuators being operationally coupled to said turn motor, said turn motor being operationally coupled to said power supply.

7. A motorized surfboard comprising:

a panel having a front edge, a back edge, a pair of side edges, a bottom surface and a top surface, said panel comprising a buoyant material such that said panel floats in water, said front edge being generally rounded, said panel widening between said side edges from said back edge to point generally between a middle portion of said panel and said front edge of said panel, said side edges tapering from said point to said front edge;

a motor housing being attached to said bottom surface of said panel, said motor housing being positioned nearer said back edge than said front edge of said panel, said motor housing having a distal wall, a proximal wall and a pair of lateral walls with respect to said front edge of said panel, said lateral walls tapering to said proximal wall such that said proximal wall is generally pointed, said housing having a bottom wall having a removable panel therein for selectively accessing an interior of said housing, said motor housing being substantially watertight;

a drive motor being positioned in said housing, a propeller being mechanically coupled to said drive motor, said propeller being positioned between said back edge of said panel and said distal wall of said housing, said drive motor comprising an electric motor;

a power supply being operationally coupled to said drive motor, said power supply being positioned in said motor housing, said power supply comprising a battery;

a handle being secured to said top surface of said panel, said handle including a bar extending upwardly from said panel, a handgrip being attached to a free end of said bar, said handgrip having a plurality of indentations therein for receiving fingers of a user;

a button being positioned on said handle for selectively turning said drive motor on or off, said button being operationally coupled to said drive motor;

a turning means for turning said drive motor comprising a turn motor mounted in said housing, a rod being coupled to said turn motor, said rod being coupled to said drive motor, said turn motor being adapted for rotating said rod, a first actuator for rotating said rod in a first direction being mounted on said handle, a second actuator for rotating said rod in a second direction being mounted on said handle, said first and second actuators being operationally coupled to said turn motor, said turn motor being operationally coupled to said power supply.

8. A motorized surfboard comprising:

a panel having a front edge, a back edge, a pair of side edges, a bottom surface and a top surface, said panel comprising a buoyant material such that said panel floats in water;

a motor housing being attached to said bottom surface of said panel, said motor housing having a distal wall, a proximal wall and a pair of lateral walls with respect to said front edge of said panel, said motor housing being substantially watertight;

a drive motor being positioned in said housing, a propeller being mechanically coupled to said drive motor, said propeller being positioned between said back edge of said panel and said distal wall of said housing;

a turning means for turning said drive motor, said turning means being operationally coupled to said drive motor; and a power supply being operationally coupled to said drive motor and positioned in said motor housing.

9. The motorized surfboard as in claim 8, wherein said front edge is generally rounded, said panel widening between said side edges from said back edge to point generally between a middle portion of said panel and said front edge of said panel, said side edges tapering from said point to said front edge.

10. The motorized surfboard as in claim 8, wherein said motor housing is positioned nearer said back edge than said front edge of said panel.

11. The motorized surfboard as in claim 8, wherein said housing has a bottom wall having a removable panel therein for selectively accessing an interior of said housing for removing said power supply disposed thereon.

12. The motorized surfboard as in claim 8, wherein said drive motor comprises an electric motor and said power supply comprises a battery.

13. The motorized surfboard as in claim 8, further including a handle being secured to said top surface of said panel, said handle including a bar extending upwardly from said panel.

14. The motorized surfboard as in claim 12, further including a handgrip being attached to a free end of said bar, said handgrip having a plurality of indentations therein for receiving fingers of a user, a button being positioned on said handle for selectively turning said drive motor on or off, said button being operationally coupled to said drive motor.

15. The motorized surfboard as in claim 8, wherein said turning means comprises a turn motor mounted in said housing, a rod being coupled to said turn motor, said rod being coupled to said drive motor, said turn motor being adapted for rotating said rod.

16. The motorized surfboard as in claim 14, wherein said turning means comprises a turn motor mounted in said housing, a rod being coupled to said turn motor, said rod being coupled to said drive motor, said turn motor being adapted for rotating said rod, a first actuator for rotating said rod in a first direction being mounted on said handle, a second actuator for rotating said rod in a second direction being mounted on said handle, said first and second actuators being operationally coupled to said turn motor, said turn motor being operationally coupled to said power supply.

* * * * *